United States Patent [19]

Webinger

[11] 4,285,427

[45] Aug. 25, 1981

[54] FOLDING SHIRT CARD AND BLANK THEREFOR

[75] Inventor: George Webinger, Minneapolis, Minn.

[73] Assignee: Champion International Corporation, Stamford, Conn.

[21] Appl. No.: 94,493

[22] Filed: Nov. 15, 1979

[51] Int. Cl.[3] ..... B65D 85/18; A41H 5/00

[52] U.S. Cl. ..... 206/292; 206/495

[58] Field of Search ..... 206/296, 292, 278, 495, 206/299; 223/71

[56] References Cited

U.S. PATENT DOCUMENTS

| | | | |
|---|---|---|---|
| 2,723,025 | 11/1955 | Dee | 206/296 |
| 4,134,524 | 1/1979 | Nakano et al. | 206/292 |

*Primary Examiner*—William T. Dixson, Jr.

*Attorney, Agent, or Firm*—Evelyn M. Sommer

[57] ABSTRACT

A shirt card, formed of a unitary blank of paperboard, for supporting a shirt during transport and display. The shirt is secured to the card without the necessity of pins. The shirt card is foldable and is self-locking in the folded position. The card comprises a main panel, a central fold line separating the main panel into top and bottom sections, a collar receiving extension at the top edge of the top section, a pair of slits receiving the sleeves of the shirt, a second set of slits receiving the sides of the shirt, and a tab and slit locking mechanism to lock the main panel in the folded position. The collar receiving extension can have a pair of opposed wing flaps for fully supporting the collar. A clothes hanger is received in the body portion of the shirt to support the shirt card with the shirt attached thereto.

7 Claims, 8 Drawing Figures

FOLDING SHIRT CARD AND BLANK THEREFOR

FIELD OF THE INVENTION

The present invention relates to a shirt card, formed of a unitary blank of paperboard, for supporting a shirt during transport and display.

BACKGROUND OF THE INVENTION

In order to preserve their shape, new shirts on display in clothing stores usually have a piece of cardboard associated therewith, with a plurality of pins, clips and collar tabs used to mount the shirt in a rigid position relative to the board. It is quite time consuming to prepare such a mounting and also requires numerous pieces of equipment. The resulting package, is usually displayed in a stacked configuration, which limits the display possibilities for the merchandise.

SUMMARY OF THE INVENTION

Accordingly, a primary object of the present invention is to provide a shirt card for supporting a shirt which does not require a plurality of pins, clips and additional fastening devices, thereby providing such a device which is less expensive to manufacture and easier and more quickly utilized.

Another object of the present invention is to provide a shirt card which may be stacked flat, hung by a clothes hanger in a folded configuration or in an extended configuration, thereby providing a versitility of display to the merchandiser.

The foregoing objects are basically attained by providing a unitary paperboard blank adapted to form a shirt card comprising a main panel having a top edge, a bottom edge, a first side edge, and a second side edge forming the periphery thereof; a fold line extending between the side edges dividing the main panel into a top section and a bottom section; first and second spaced, parallel slits located in the top section; the top edge having a outwardly extending area in the center thereof; and third and fourth slits located in the bottom section, each of the third and fourth slits extending from a position in the bottom section to the outer periphery thereof defined by the first and second side edges and the bottom edge. In addition, the top section has a fifth slit therein and the bottom section has an interior tab formed therein by a cut line, the fifth slit and the tab being substantially equally spaced from the fold line.

The outwardly extending area in the center of the top edge receives the collar of the shirt, the parallel slits receive the sleeves of the shirt, and the third and fourth slits receive the sides of the shirt, the main body portion of the shirt lying on the main panel of the blank. Upon folding along the central fold line, the tab is received in the fifth slit to lock the shirt card in a folded position.

A clothes hanger is receivable in the body portion of the shirt so that the entire combination can be hung on a rack.

Other objects, advantages and salient features of the present invention will become apparent from the following detailed description, which, taken in conjunction with the annexed drawings, discloses preferred embodiments of the present invention.

DRAWINGS

Referring now to the drawings which form a part of this original disclosure:

DETAILED DESCRIPTION OF THE INVENTION

Figure 1:
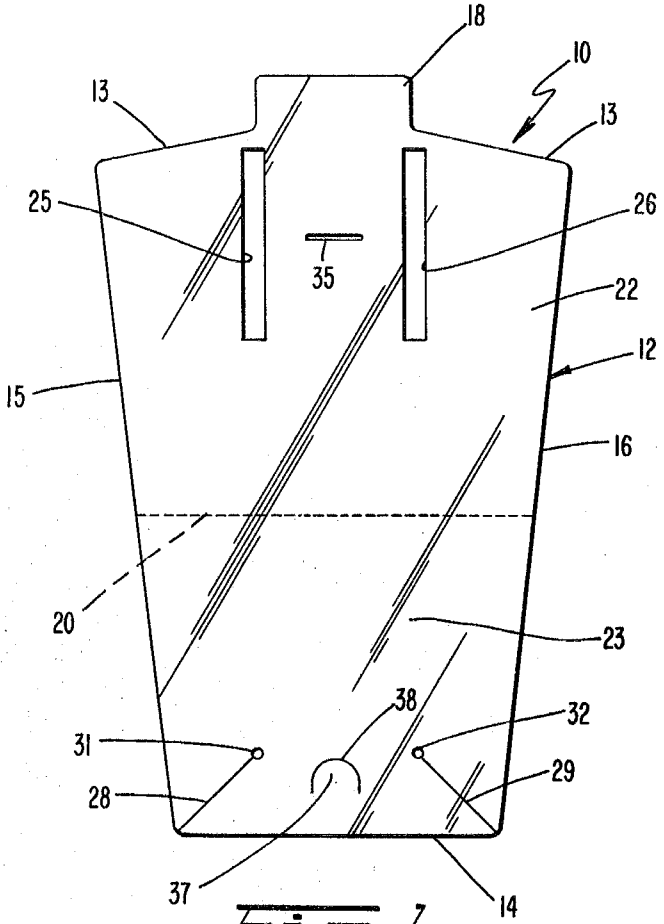
FIG. 1 is a front elevational view of a blank in accordance with the present invention.

Referring now to FIG. 1, a blank 10 formed of thin, foldable paperboard is shown comprised of a main panel 12 having a top edge 13, a bottom edge 14, a first side edge 15 and a second side edge 16 forming the periphery thereof. The side edges 15 and 16 are straight and taper inwardly from the top edge 13 to the bottom edge 14. The bottom edge 14 is also straight, while the top edge 13 tapers upwardly and has at the center thereof an outwardly extending area or portion 18.

A straight fold line 20 extends transversely across the main panel 12 between side edges 15 and 16 slightly below the center of the main panel 12. This fold line 20 divides the main panel into a top section 22 and a bottom section 23. A first slit 25, in the form of a rectangular opening, and a second slit 26, in the form of a rectangular opening, are located in the top section 22, these slits being parallel to each other and substantially perpendicular to fold line 20. They are located below the outwardly extending area 18 and have their uppermost portions substantially in the same plane containing the tops of the first and second side edges 15 and 16 of the main panel 12.

Located in the bottom section 23 are third and fourth slits 28 and 29, in the form of cut lines, each extending from a position in the bottom section to the outer periphery thereof defined by the first and second side edges 15 and 16 and the bottom edge 14. In particular, the third and fourth slits respectively intersect the outer periphery of the main panel at the intersections of the first side edge 15 and the bottom edge 14, and the second side edge 16 and the bottom edge. As seen in FIG. 1, the third and fourth slits define with the bottom edge 14 angles of about 45°. At the interior end of each of the third and fourth slits are, respectively, enlarged circular apertures 31 and 32.

Located in the top section 2 between the first and second slits 25 and 26 in a fifth slit 35, in the form of a rectangular opening, which has its longer axis substantially parallel to fold line 20 and is centered between the sides of the main panel.

Located in the bottom section 23 is a locking tab 37 defined by a semi-circular cut-line 38, the tab being located substantially centrally of the third and fourth slits 28 and 29. In addition, the tab 37 is located substantially along the longer longitudinal axis of the main panel 12, in line with the fifth slit 35. The distance between the tab 37 and the fold line 20 is substantially the same as the distance between the fifth slit 35 and the fold line 20 so that upon folding of the blank 10 along fold line 20 the tab 37 is releasably receivable in the fifth slit 35.

As will be described in more detail hereinafter, the first and second slits 25 and 26 receive and support the sleeves of the shirt to be mounted on the shirt card blank 10, the outwardly extending area 18 receives and supports the collar of the shirt, and the third and fourth slits 28 and 29 receive and support the sides of the shirt.

Figure 2:
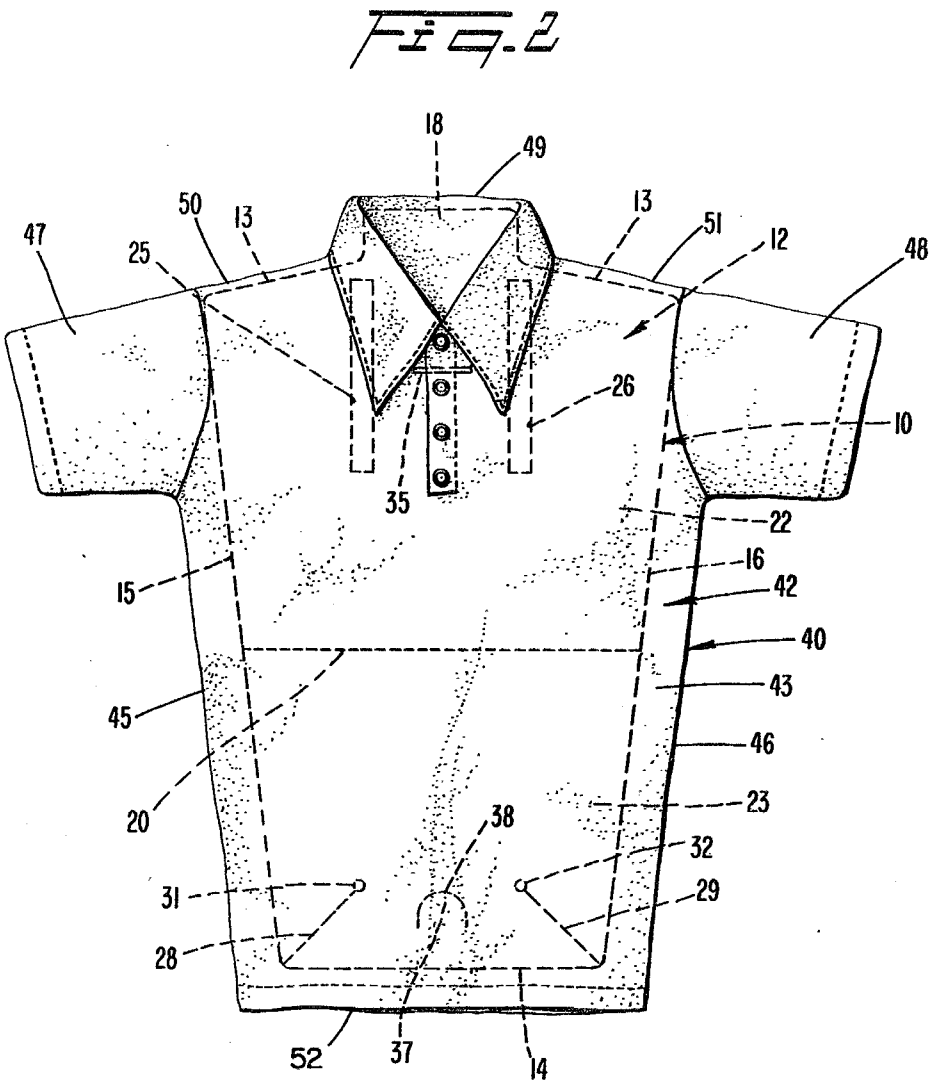
FIG. 2 is a front elevational view of the blank in accordance with the present invention, shown in dotted lines, overlaid by a shirt to be supported on the blank.

Turning now to FIG. 2, a shirt 40 to be supported by the shirt card blank 10 of the present invention is shown comprising a main body portion 42 having a front 43 and a back 44 (shown in FIG. 3), a first side 45, a second side 46, a first sleeve 47, a second sleeve 48, a collar 49, a first shoulder 50, a second shoulder 51 and a tail 52.

As seen in FIG. 2, the main body portion 42 of the shirt 40 overlies the top and bottom sections 22 and 23 of the main panel 12 with the sides 45 and 46 extending outwardly past the first and second side edges 15 and 16 of the main panel 12.

Figures 3, 4, 5:
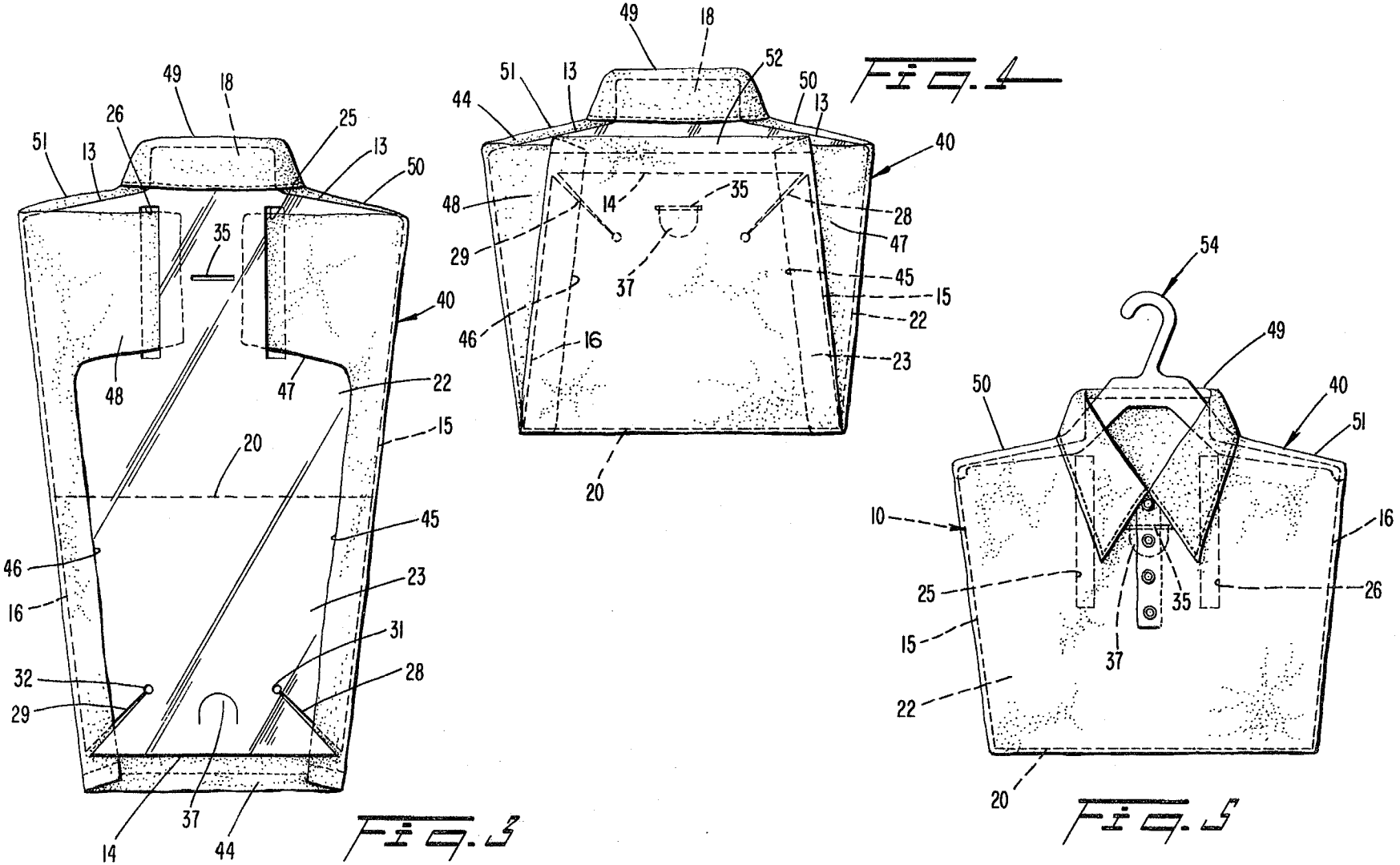
FIG. 3 is a rear elevational view of the blank in accordance with the present invention having a shirt received thereon.
FIG. 4 is a rear elevational view similar to that shown in FIG. 3 except that the shirt card blank has been folded along the central fold line and locked in the folded position.
FIG. 5 is a front elevational view of the combination shown in FIG. 4 with the addition of a clothes hanger received in the shirt, the hanger being shown in phantom lines in those portions in which it is received in the shirt.

As seen in FIG. 3, the outwardly extending area 18 of the top section 22 is received in and supports the collar 49 of the shirt, that is, the rear portion of the collar is folded downwardly over the extending area 18 so that the area is located between the main portion of the collar and the backwardly and downwardly extending folded portion. In addition, the sleeves 48 and 49 are wrapped around the sides of the top section 22 and are received and supported respectively in the first and second slits 25 and 26. The sides 45 and 46 of the shirt 40 are wrapped around the edges 15 and 16 so they overlie the back portion of the shirt card and the bottom ends of these sides 45 and 46 are manipulated respectively into a receiving relationship with the now split slits 28 and 29 in the bottom section 23. Thus, the shirt 40 is securely supported on the shirt card without the necessity of pins, clips or other similar devices.

As seen in FIG. 4, the shirt card is folded along fold line 20 with the shirt 40 attached thereto and the tab 37 is received in the fifth slit 35. This locks the combined shirt card and shirt in the folded configuration seen in FIG. 4 from the rear, and seen in FIG. 5 from the front.

As seen in FIG. 5, a clothes hanger 54 can be manipulated into the shirt 40 and support the combined shirt 40 and shirt card 10 in a hanging position, the outer portions of the hanger 54 being supported by the shoulders 50 and 51 of the shirt itself. In this configuration seen in FIG. 5, the combined shirt and shirt card can be hung on double-racks since the shirt and shirt card are in a folded configuration. In the alternative, the locking tab 37 and fifth slit 35 can be released, with the combined shirt and shirt card allowed to hang in the fully extended position, seen in FIG. 3. In addition, the clothes hanger 54 need not be utilized, in which case the combined shirt and shirt card can be stacked in the folded position seen in FIGS. 4 and 5.

Figures 6, 7, 8:
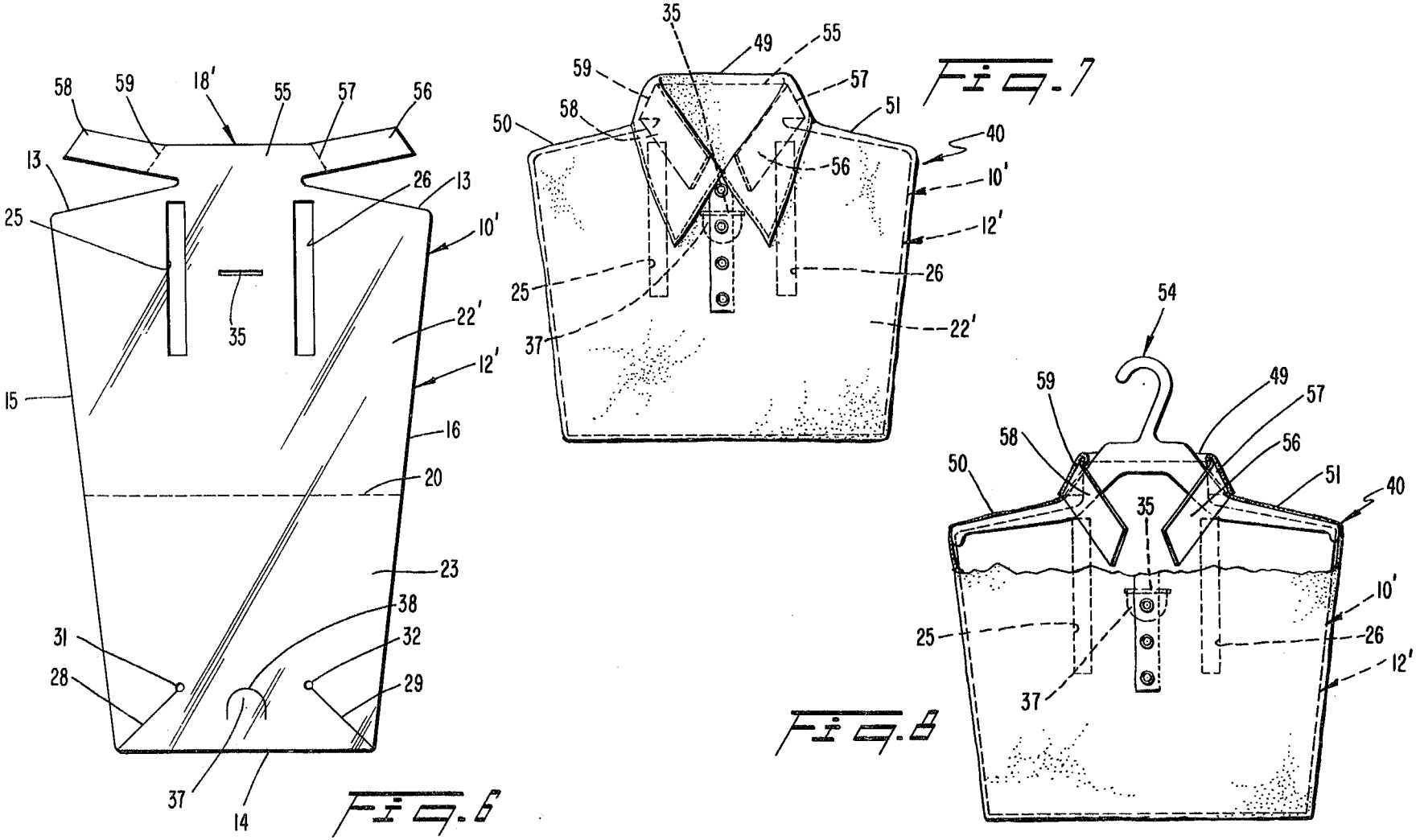
FIG. 6 is a front elevational view of a modified embodiment of the shirt card blank shown in FIG. 1 having wing flaps at the top thereof.
FIG. 7 is a front elevational view of a shirt received on a shirt card shown in FIG. 6, the shirt card being represented by dotted lines.
FIG. 8 is a front elevational view similar to FIG. 8 with parts cut away to show a clothes hanger received inside the shirt and being in contact with the wing flaps on the collar supporting portion of the shirt card.

Referring now to FIGS. 6–8, a modified embodiment of the present invention is shown including shirt card blank 10' which is in all respects the same as shirt card blank 10 shown in FIGS. 1–5 except for the outwardly extending area 18' on the top section 22'. Those elements of blank 10' which are the same as those in blank 10 are given the same character numerals, different ones have a prime next to the character numeral and new elements have new character numerals.

As seen in FIG. 6, the basic difference comprises an outwardly extending area 18' comprising a central portion 55 extending upwardly and outwardly from the top edge 13 of the top section 22' of the main panel 12', a first wing flap 56 hingedly coupled to one side of the central portion along fold line 57, and a second wing flap 58 hingedly coupled to the other side of the central portion along fold line 59. As seen in FIGS. 6–8, each of the wing flaps 56 and 58 is in a configuration which approximates a parallelogram.

The basic purpose of these wing flaps is to more fully support the collar 49 of the shirt 40 and in addition to support a hanger 54 used therewith.

Thus, as seen in FIG. 7, the collar 49 of the shirt 40 is received on the central portion 55 in the back thereof and is received on the two sides in the front thereof over the wing flaps 56 and 58.

As seen in FIG. 8, in which a portion of the top of the shirt 40 is cut away, when a clothes hanger 54 is maneuvered into the shirt 40 advantageously the wing flaps 56 and 58 provide a support area which the hanger 54 can contact. In particular, the clothes hanger 54 contacts the bottoms of the first and second wing flaps 56 and 58 as seen in FIG. 8.

While various advantageous embodiments have been chosen to illustrate the invention, it will be understood by those skilled in the art that various changes and modifications can be made therein without departing from the scope of the invention as defined in the appended claims.

What is claimed is:

1. A shirt card for supporting a shirt having a body portion with a collar at the top, a tail at the bottom and two sleeves at the sides, comprising:

a main panel having a top edge, a bottom edge, a first side edge and a second side edge forming the periphery thereof;

a fold line extending between said side edges dividing said main panel into a top section and a bottom section, the body portion of the shirt overlying said top and bottom sections;

means, in said top section, for receiving the sleeves of the shirt;

means, located in said bottom section, for receiving the sides of the shirt; said means including a pair of slits extending from the interior of said bottom section to the outer periphery thereof, and means, located in said top section and in said bottom section, for locking said sections together upon folding thereon about said fold line.

2. A shirt card according to claim 1, wherein said means for locking comprises a slit, and a tab releasably receivable in said slit.

3. A shirt card according to claim 1, wherein said means for receiving the sleeves of the shirt comprises a pair of parallel slits formed in said top section.

4. A shirt card according to claim 1, wherein said means for receiving the collar of the shirt comprises an outwardly extending portion of said top edge.

5. A shirt card according to claim 4, wherein said outwardly extending portion comprises a central portion, a first wing flap hingedly coupled to one side of said central portion, and a second wing flap hingedly coupled to the other side of said central portion.

6. A shirt card according to claim 5, and further comprising a clothes hanger received in the body portion of the shirt and contacting the bottoms of said first and second wing flaps.

7. A shirt card according to claim 1, and further comprising a clothes hanger received in the body portion of the shirt.

* * * * *